US010364986B2

(12) United States Patent
Malm et al.

(10) Patent No.: US 10,364,986 B2
(45) Date of Patent: Jul. 30, 2019

(54) EXCESS GAS COMBUSTION IN HEAVY OIL PRODUCTION

(71) Applicant: REM Technology Inc., Calgary (CA)

(72) Inventors: Howard L. Malm, Coquitlam (CA); Leslie Allan Keast, Calgary (CA); Greg Brown, Calgary (CA)

(73) Assignee: REM Technology Inc., Calgary (CA)

( * ) Notice: Subject to any disclaimer, the term of this patent is extended or adjusted under 35 U.S.C. 154(b) by 735 days.

(21) Appl. No.: 14/883,879

(22) Filed: Oct. 15, 2015

(65) Prior Publication Data

US 2016/0109122 A1 Apr. 21, 2016

Related U.S. Application Data

(60) Provisional application No. 62/064,100, filed on Oct. 15, 2014.

(51) Int. Cl.

| | |
|---|---|
| ***F23C 3/00*** | (2006.01) |
| ***F23G 7/08*** | (2006.01) |
| ***F23N 5/02*** | (2006.01) |
| ***F23G 5/50*** | (2006.01) |
| *F23N 5/18* | (2006.01) |

(52) U.S. Cl.

CPC ..... *F23G 7/085* (2013.01); *F23C 3/002* (2013.01); *F23C 3/004* (2013.01); *F23G 5/50* (2013.01); *F23G 7/08* (2013.01); *F23N 5/025* (2013.01); *F23N 2005/185* (2013.01); *F23N 2025/04* (2013.01); *F23N 2037/02* (2013.01); *F23N 2037/08* (2013.01)

(58) Field of Classification Search

CPC ..... F23G 7/085; F23N 5/025; F23C 3/002; F23C 3/004

See application file for complete search history.

(56) References Cited

U.S. PATENT DOCUMENTS

| | | | | |
|---|---|---|---|---|
| 5,918,670 | A * | 7/1999 | Coutts | E21B 34/16 166/321 |
| 6,293,786 | B1 * | 9/2001 | Lasagni | F23D 14/105 239/432 |
| 7,520,743 | B1 * | 4/2009 | Roberts | E21B 43/34 196/46 |
| 2014/0147795 | A1 * | 5/2014 | Tremblay | F23G 7/085 431/5 |

FOREIGN PATENT DOCUMENTS

| | | |
|---|---|---|
| CA | 2822267 | 7/2013 |

* cited by examiner

*Primary Examiner* — Avinash A Savani
*Assistant Examiner* — Aaron H Heyamoto
(74) *Attorney, Agent, or Firm* — Thompson Hine LLP

(57) ABSTRACT

A system and method for vent gas combustion in storage tank for heavy oil production is provided. Auxiliary burners located are provided for combusting the well casing gas. A burner management system for controlling the auxiliary burners is provided which receives a gas pressure value and initiates the auxiliary burners based upon one or more threshold values when the gas pressure exceeds the one or more pressure values. An auxiliary exhaust stack may be collocated with a main exhaust stack of a tank heater for the storage tank.

21 Claims, 13 Drawing Sheets

Horizontal Cross-sectional View

EXCESS GAS COMBUSTION IN HEAVY OIL PRODUCTION

CROSS REFERENCE TO RELATED APPLICATIONS

This application claims priority from U.S. Provisional Patent Application No. 62/064,100 filed Oct. 15, 2014 the entirety of which is hereby incorporated by reference for all purposes.

TECHNICAL FIELD

The present disclosure relates to heavy oil collection and in particular to combustion of excess gases generated during heavy oil production and storage.

BACKGROUND

In the extraction of petroleum products from geologic formations a wide range of properties are encountered. Often the petroleum products, when brought to the surface, are composed of gaseous, liquid and solid components. The gaseous components, known as solution gases, are mainly hydrocarbons with 1 to 4 carbon atoms with smaller amounts of hydrocarbons with 5 or more carbon atoms. According to the well flow rates the gaseous component portion may be uneconomic to collect as collection requires the construction of a gas pipeline, local gas compression and possibly local treatment equipment to remove liquids and particulate contamination.

An example of such a situation is a well drilled to recover heavy oil. Heavy oil is a petroleum product with a higher viscosity compared with normal crude oil. As such its flow rate from the geologic formation to the drilled well is generally less than that of normal crude oil. In the well both the gaseous and liquid components are collected. Sometimes sand or other solid matter is contained in the liquid. The liquid portion containing hydrocarbons and water with suspended solids is raised to the surface by a lifting mechanism and the gaseous portion is vented to the surface, normally via the well casing. This gas is often described as well casing gas.

At most locations a natural gas engine supplies the hydraulic power for the well pump and supplies heat from the engine coolant to prevent freezing of the casing gas. At a typical heavy oil well, with oil production rate of 4 to 80 or more barrels per day (0.6 to 13 $m^3$/d), the oil, water and particulate solids (well output) are collected into a storage tank at the well-head. Due to its relatively high viscosity, it is common practice to heat the stored well output in the storage tank to enhance the separation of the water and solids from the petroleum component. In addition the heating reduces the oil viscosity which allows transfer to a collection tanker. Often the storage tank is vented to the atmosphere so that gases that evolve when the well output is heated escape to the atmosphere. The gas that evolves from the tank is often called tank gas.

At locations where the well casing gas flow is insufficient to power the natural gas engine and/or the tank heater, supplementary fuel, usually pipeline natural gas or locally stored liquid petroleum fuel, for example propane, is used. If there is sufficient well casing gas being evolved from the well, that gas is used for the process heater which maintains the stored oil at the desired elevated temperature and the engine. Excess gas is vented.

Both the vented tank gas and the vented casing gas typically contain 90% or more methane, a potent greenhouse gas with a global warming effect over a 100 year period, per unit of mass, of 21 times that of carbon dioxide, $CO_2$, the reference greenhouse gas. To reduce the greenhouse gas amount from a heavy oil well-head where the gases are vented to atmosphere and to reduce other undesired environmental and health effects from the vented gases, a means of combusting the vented gases is beneficial.

At some sites the heat provided by the engine coolant may be insufficient to prevent freezing of the oil and gas transfer piping in harsh winter conditions.

While an open flare can be used to combust more than 95% of the vented gas, it is generally undesirable for environmental and public relations reasons. There is a need for a system that can provide additional heat to prevent freezing and also combust both the excess well casing gas and the tank gas in an enclosed apparatus to reduce the emissions of methane to the atmosphere and so reduce the greenhouse gas emissions from well sites, and particularly heavy oil well-head sites and to reduce the undesired environmental and health effects from the vented gases.

Casing gas flow measurements from heavy oil well sites show that often the casing gas flow exceeds the gas used by the local engine, if present, and the design capacity of the existing burner. Hence there is a need for a system, method and apparatus that can combust the otherwise vented gases when the vented gas flow rates exceed the capacity of the existing burner and the local engine, if present.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
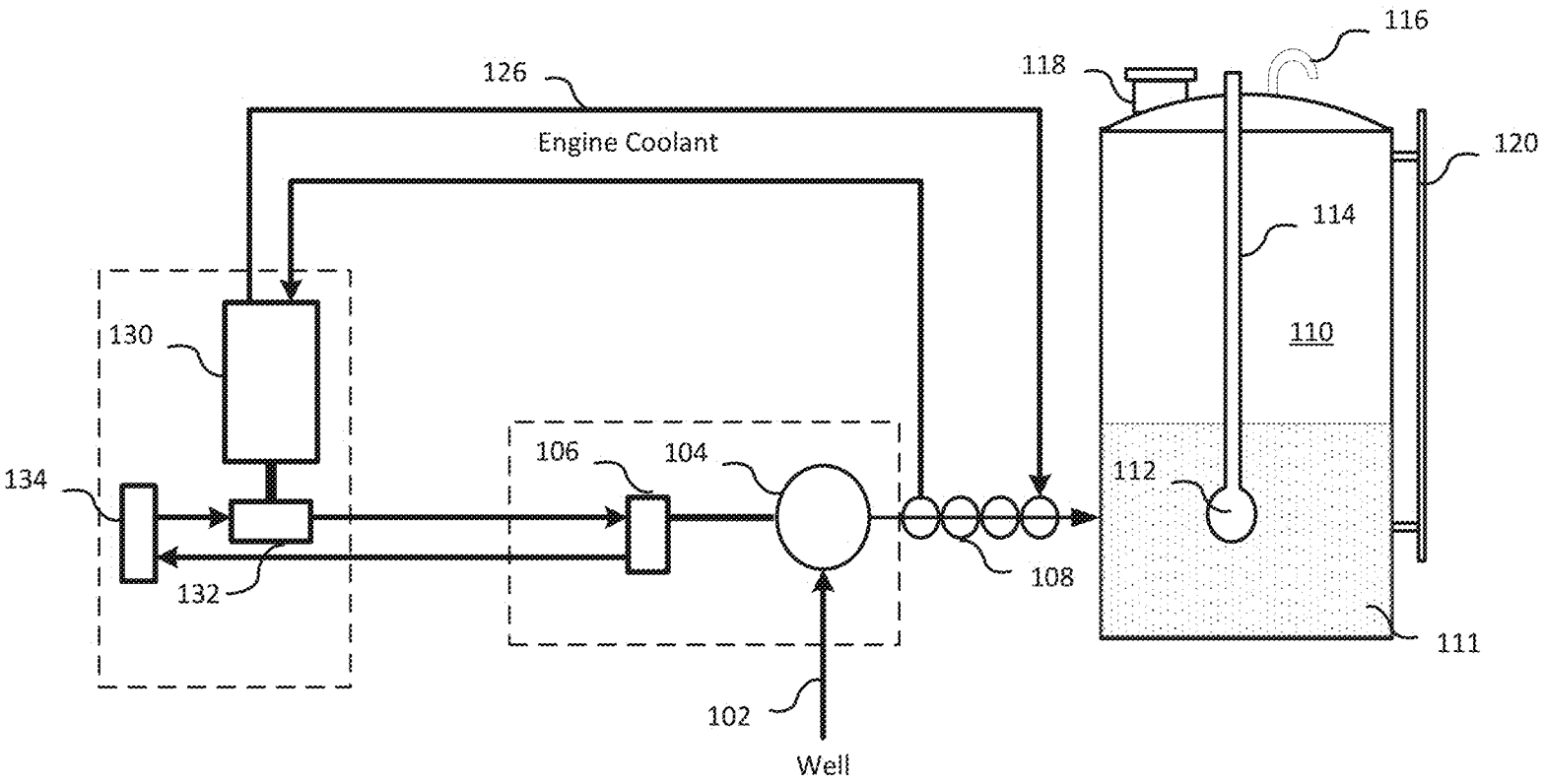
FIG. 1 shows a schematic of a heavy oil facility.

Embodiments are described below, by way of example only, with reference to FIGS. 1-13. The auxiliary burner system for heavy oil facilities described provides a method to combust vented casing or tank gases within an existing burner system. The system can adapt to a wide variation in flow rates and enables the extraction of process heat from combustion of the excess gases. The auxiliary burner system can enable trouble-free operation in cold weather environments and may be modified to meet existing standards and safety requirements.

In accordance with an aspect of the present disclosure there is provided a system for vent gas combustion in storage tank for heavy oil production, the system comprising: a pressure sensor for determining a gas pressure value of well casing gas; a first auxiliary burner located for combusting the well casing gas; a second auxiliary burner located with the first auxiliary burner for combusting the well casing gas; and a burner management system for controlling the first and second auxiliary burners, the burner management system receiving the gas pressure value and initiating the first auxiliary burner and second auxiliary burner based upon one or more threshold values when the gas pressure exceeds the one or more pressure values.

In accordance with another aspect the first and second auxiliary burners are collocated within an auxiliary exhaust stack.

In accordance with another aspect the first and second auxiliary burners are collocated within an auxiliary exhaust stack next to a tank heater exhaust stack from a tank heater in the storage tank for heating oil stored in the storage tank.

In accordance with another aspect a blower is provided to supply additional air to the first auxiliary burner and second auxiliary burner.

In accordance with another aspect the auxiliary exhaust stack is coupled to a tank heater exhaust stack from a tank heater in the storage tank for heating oil stored in the storage tank wherein the tank heater exhaust stack and auxiliary exhaust stack join a main exhaust stack having a larger diameter than the auxiliary exhaust or tank heater exhaust.

In accordance with another aspect a heat exchanger is coupled to the main exhaust stack.

In accordance with another aspect a tank heater exhaust stack from a tank heater shares a common exhaust stack with the auxiliary exhaust stack.

In accordance with another aspect a common exhaust stack is divided to provide the auxiliary exhaust stack and a tank heater exhaust stack from a tank heater.

In accordance with another aspect a pilot for the first auxiliary burner and second auxiliary burner, where in the pilot is initiated prior to initiating of the first auxiliary burner or second auxiliary burner when the gas pressure exceeds a pilot pressure threshold value.

In accordance with another aspect a pilot for the first auxiliary burner and second auxiliary burner, where in the pilot is on at all times.

In accordance with another aspect a pilot for the first auxiliary burner and second auxiliary burner, where in the pilot is on when the tank heater is not on.

In accordance with another aspect a pressure sensor for determining pressure of gas from the storage tank wherein excess gas from the storage tank is provided to the first or second auxiliary burners.

In accordance with another aspect a Venturi device for passing well casing gas to the first and second auxiliary burners and for drawing gas from the storage tank.

In accordance with another aspect a back-pressure valve coupled to a tank vent of the storage tank such that suction pressure does not drop below one atmosphere.

In accordance with another aspect an over pressure release is opened to vent excess gas when pressure exceeds a capacity of the first and second auxiliary burners.

In accordance with another aspect a regulator associated with each of the respective first and second auxiliary burners.

In accordance with another aspect the first and second burners are initiated sequentially as the pressure value increases.

In accordance with another aspect the first and second burners are initiated dynamically based upon the pressure value and a respective capacity of the first auxiliary burner and second auxiliary burner.

In accordance with another aspect the first auxiliary burner and second auxiliary burner are each associated with a respective shut-off valve, the respective shut-off valve is opened or closed by the burner management system.

In accordance with another aspect the second auxiliary burner is a larger capacity than the first auxiliary burner.

In accordance with another aspect a tank heater is initiated when the gas pressure value is below the one or more threshold values and a liquid in a tank coupled to the tank heater is below a first desired temperature.

In accordance with another aspect the tank heater is initiated when the gas pressure value is above the one or more threshold values and the liquid in the tank is below a second desired temperature.

In accordance with yet another aspect of the present disclosure there is provided a method for vent gas combustion from a storage tank for heavy oil production, the method comprising: determining a gas pressure value of well casing gas; initiating a first auxiliary burner to combust the well casing gas when a first on-pressure threshold value is exceeded, the first auxiliary burner is active until the pressure value is below a first off-pressure threshold; and initiating a second auxiliary burner located the second auxiliary burner to combust well casing gas when a second on-pressure threshold value is exceeded, the second auxiliary burner is active until the pressure value is below a second off-pressure threshold.

In accordance with another aspect a pilot is initiated when the gas pressure exceeds a pilot on-pressure threshold value and is below a pilot off-pressure threshold value prior to initiating the first or second auxiliary burner.

In accordance with another aspect a pressure sensor determines a gas pressure from the storage tank.

In accordance with another aspect a Venturi device for passing gas to the burners and for drawing tank gas from the storage tank.

In accordance with another aspect closing a back-pressure valve coupled to a tank vent when suction pressure drops drop below one atmosphere.

In accordance with another aspect an over pressure release activated to vent excess gas when the pressure exceeds a capacity of the first and second burners.

In accordance with another aspect the first on pressure threshold value, first off pressure threshold value, second on pressure threshold value and second off pressure threshold value are sequentially in increasing order.

In accordance with another aspect the first on-pressure threshold value, the first off-pressure threshold value, the second on-pressure threshold value and the second off-pressure threshold value are dynamically determined based upon the determined gas pressure value.

In accordance with another aspect a tank heater is initiated when the gas pressure value is below the one or more threshold values and a liquid in a tank coupled to the tank heater is below a first desired temperature.

In accordance with another aspect the tank heater is initiated when the gas pressure value is above the one or more threshold values and the liquid in the tank is below a second desired temperature.

In accordance with another aspect the first and second auxiliary burners are co-located within an auxiliary exhaust stack.

In accordance with another aspect the auxiliary exhaust stack is coupled to a tank heater exhaust stack from a tank heater in the storage tank for heating oil stored in the storage tank wherein the tank heater exhaust stack and auxiliary exhaust stack join a main exhaust stack having a larger diameter than the auxiliary exhaust or tank heater exhaust.

In accordance with another aspect initiating a pump coupled to a heat exchanger in the exhaust stack when the auxiliary burners are active.

In accordance with another aspect the first and second auxiliary burners are collocated within an auxiliary exhaust next to a tank heater exhaust stack from a tank heater in the storage tank for heating oil stored in the storage tank.

In accordance with another aspect a pilot for the first auxiliary burner and second auxiliary burner is initiated prior to initiating of the first auxiliary burner or second auxiliary burner when the gas pressure exceeds a pilot pressure threshold value.

In accordance with another aspect a pilot for the first auxiliary burner and second auxiliary burner is on at all times.

In accordance with another aspect a pilot for the first auxiliary burner and second auxiliary burner is on when the tank heater is not on.

In accordance with another aspect a blower is initiated to supply additional air to the first auxiliary burner and second auxiliary burner.

In accordance with still yet another aspect of the present disclosure there is provided a non-transitory computer readable memory comprising instructions for controlling vent gas combustion from a storage tank for heavy oil production, the instructions which when executed a processor perform: determining a gas pressure value of well casing gas; initiating a first auxiliary burner to combust the well casing gas when a first on-pressure threshold value is exceeded, the first auxiliary burner is active until the pressure value is below a first off-pressure threshold; and initiating a second auxiliary burner located the second auxiliary burner to combust well casing gas when a second on-pressure threshold value is exceeded, the second auxiliary burner is active until the pressure value is below a second off-pressure threshold.

Canadian Patent Application No. 2,822,267 filed Jul. 31, 2013, hereby incorporated by reference in its entirety, describes an auxiliary burner that is inserted in the exhaust stack of an existing burner such that combustible gases from closed vessels could be directed to the existing burner and used as fuel gas for the existing burner or burned in the auxiliary burner in the exhaust stack according to the pressure of the gas in the closed vessel. Use of an existing burner places an upper limit on the maximum amount of combustible gases that can be consumed by this arrangement.

FIG. 1 shows the general arrangement for heavy oil collection. The well may be vertical or vertical and horizontal. The water, oil, solids and gas from the formation flow from the well 102 by heavy oil pump 104. The liquids and particulates are raised to the surface a lifting mechanism such as the heavy oil pump 104. The heavy oil pump 104 can be driven by a hydraulic motor 106 or other power source. An engine 130 drives hydraulic pump 132 for circulating hydraulic oil from reservoir 134 to the hydraulic motor 106 or other power source. Gas which is at greater than atmospheric pressure flows to surface typically through a well casing from the well 102. One or more storage tanks 110 collects the liquids and particulates 111. To enable improved separation of the oil, solids and water, the well output is heated by a burner assembly 112 which uses either the well casing gas or supplemental fuel gas (natural gas or propane). The burner assembly 112 is located within the liquids storage tank 110. A stack 114 that directs the burner exhaust gases upwards for atmospheric dispersal is provided on the outside of the tank 110.

A vapour vent 116 allows the tank gases to flow to the atmosphere. An access hatch 118, known as a thief hatch can be provided to allow access to the tank for inspection. The hatch 118 may also contain over and under pressure relief mechanisms. The tank 110 may also be fitted with level indicator 120 or level sensors to indicate the amount of liquid is present in the tank 110. If electrical power is not economically available at the well site, the engine 130 provides the power for the site. The engine coolant 126 can provide heat for the pipes 108 between the well 102 and the tank 110.

As the liquids 111 from the well 102 are heated, additional gas is evolved in the tank 110 and, if not captured, is vented to the atmosphere. As previously noted, if the amount of well casing gas is greater than the needs of the burner assembly 112 and the engine 132, the excess gas is vented to atmosphere.

Figure 2:
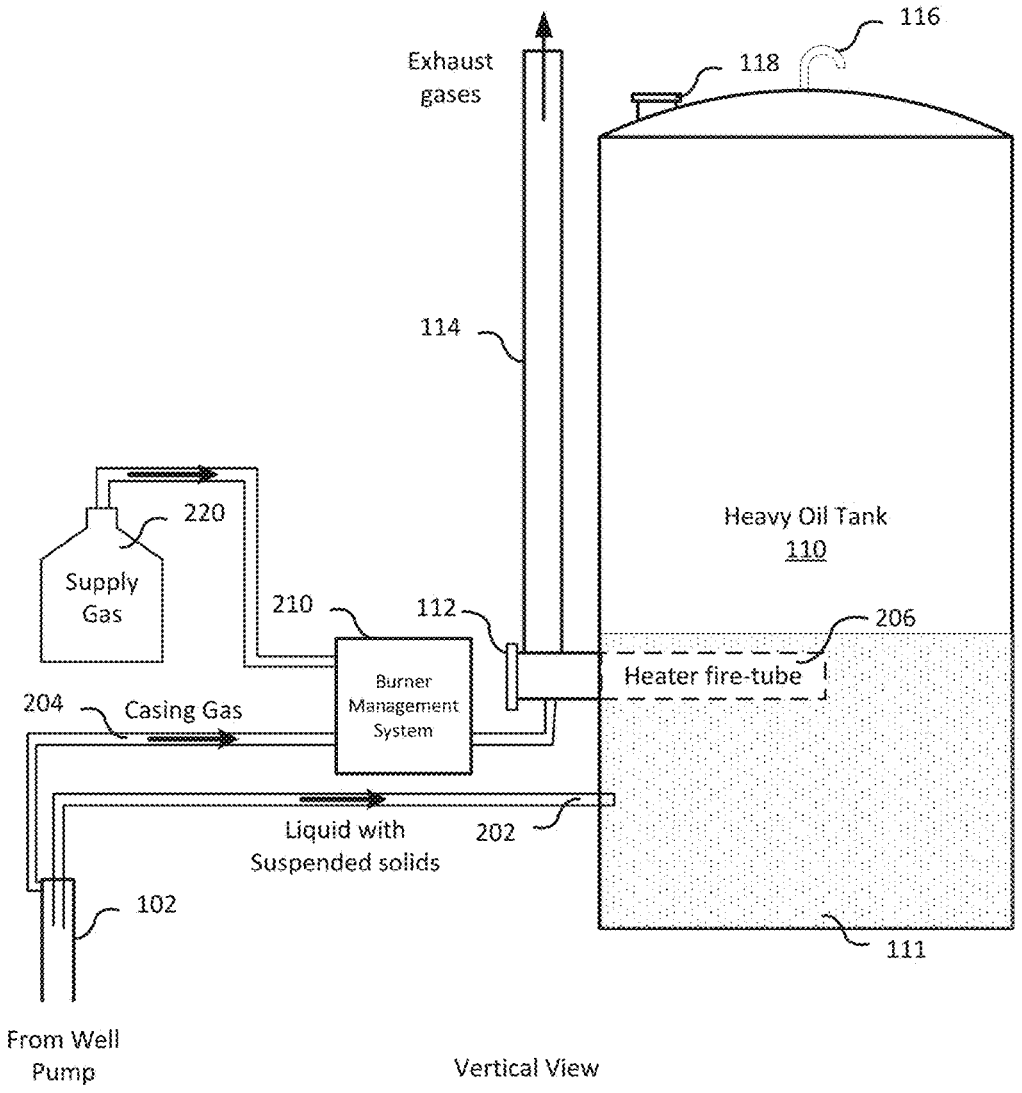
FIG. 2 shows a vertical view of a heavy oil facility.
Figure 3:
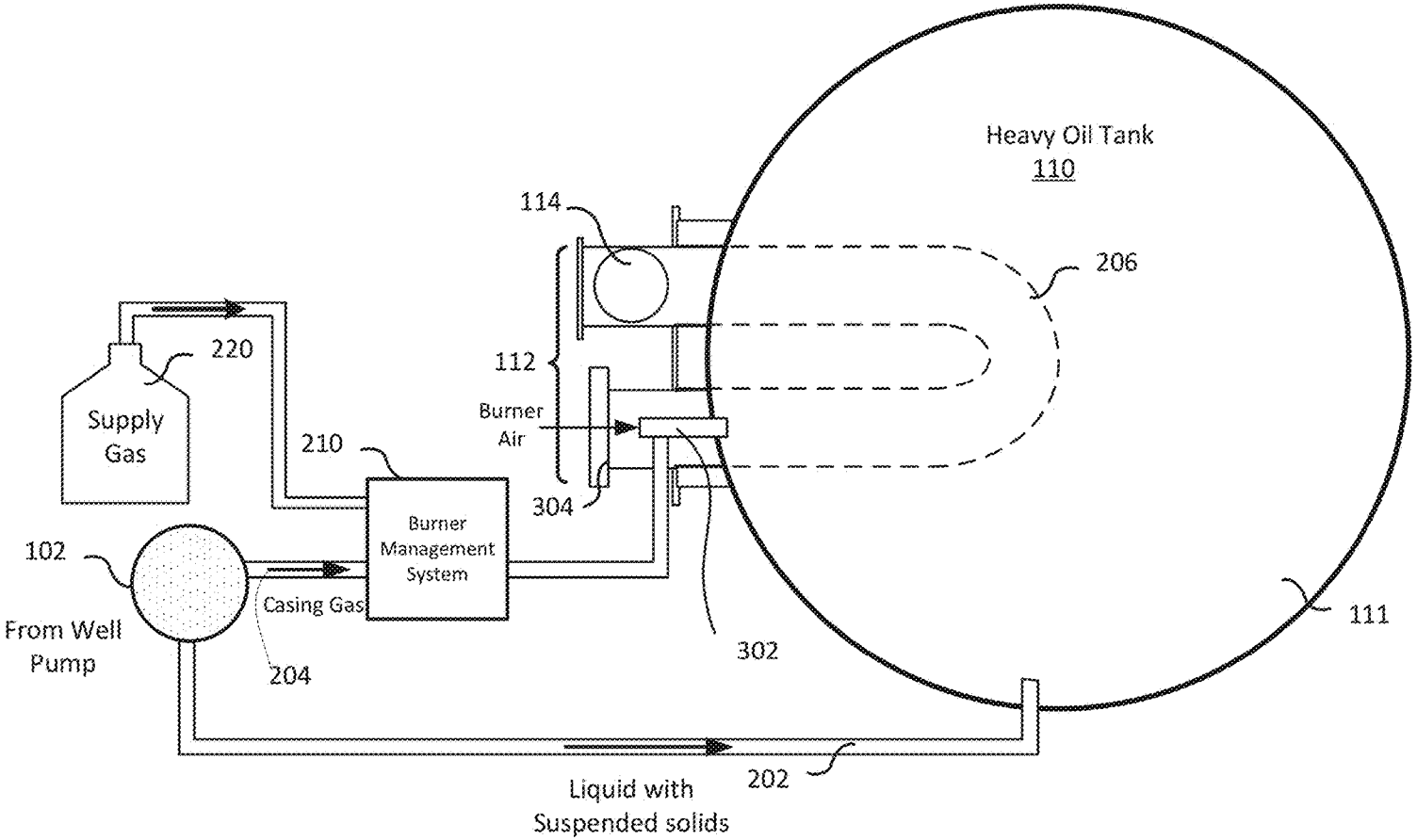
FIG. 3 shows a horizontal cross-sectional view of a heavy oil facility.

Referring to FIGS. 2 and 3, the burner assembly 112 is located inside a U-shaped fire-tube 206 which is immersed in the tank 110 liquids 111. A temperature sensor (not shown) measures the temperature of the liquid. If the temperature is below the set-point, a burner management system (BMS) 210 starts a pilot (not shown) and, if the pilot flame is stable, opens a valve on the fuel supply line, and provides fuel gas for the burner 302. The BMS 210 controls the pilot and turns the burner on or off to maintain the tank liquid temperature at or near a desired temperature set-point. The fuel gas may either be the well casing gas 204 or externally supplied natural gas or propane 220 depending on the well casing gas 204 flow and demand requirements. A flame arrester 304 ensures that air can enter to combust the fuel gas, but prevents the flame from escaping from the fire-tube 206. The vertical exhaust stack 114 allows the combustion products to escape and in so doing, provides a draft to ensure a supply of fresh air reaches the burner 302.

As noted previously, when the well is in operation, well casing gas 204 is routinely used for the burner 112, and if no external electrical power is available, the well casing gas is used for fuel for a natural gas engine needed for the well pump 104 or lifting device, shown in FIG. 1. Any excess casing gas is vented to the atmosphere.

Figure 4:
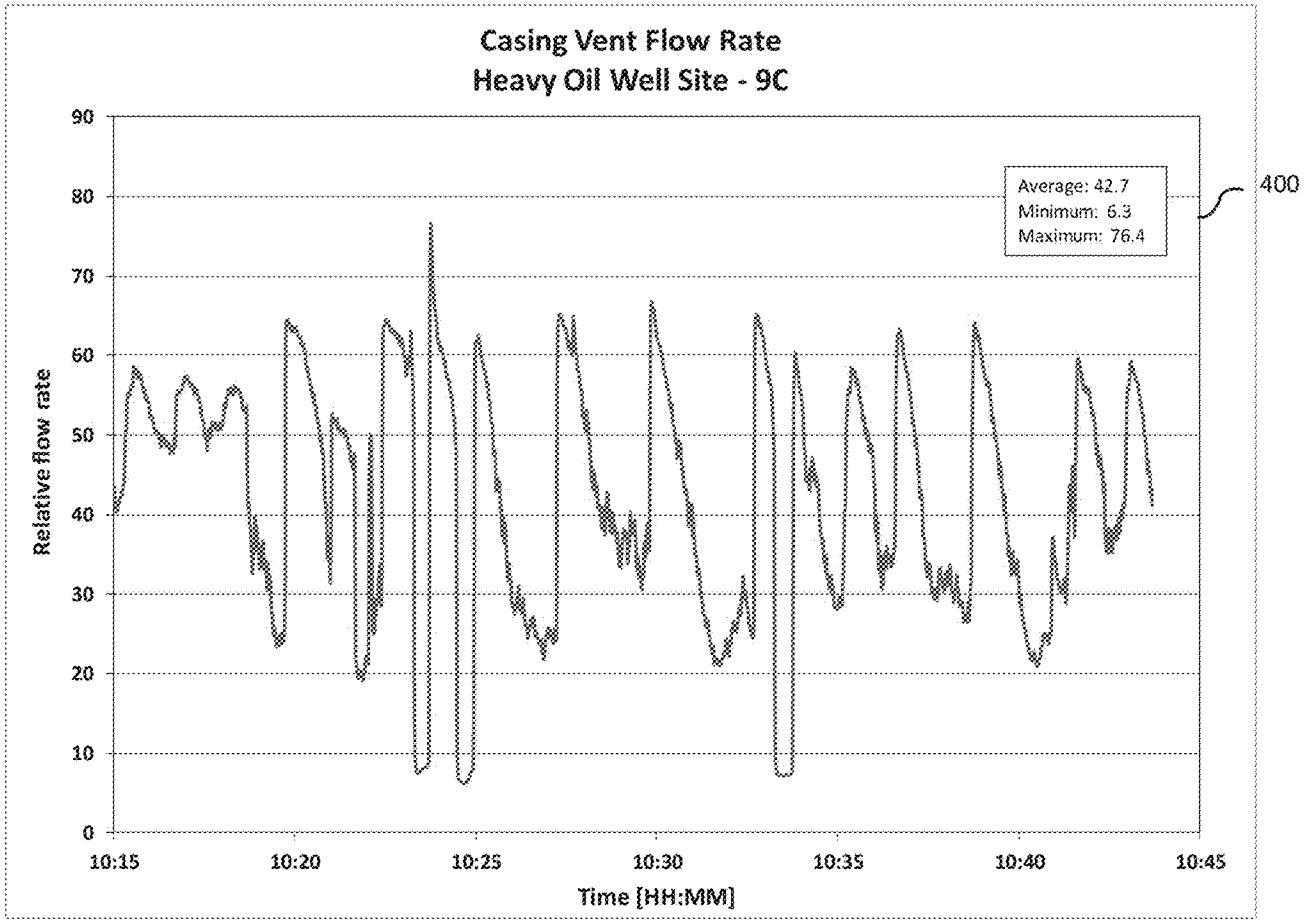
FIG. 4 shows a graph of relative flow of vented well casing gas at a sample heavy oil well facility.

It is well-known that from heavy oil wells the flow rate of the well casing gas 204 can be quite variable relative to time as is shown by a typical graph 400 in FIG. 4 showing relative gas flow rate. Analysis of the vented gas composition shows that it normally consists of more than 90% methane, which is known to have a greenhouse effect some 21 times that of carbon dioxide. If the amount of vented gas is uneconomical to collect for commercial purposes, then combustion of such gas to destroy the methane component and produce water and carbon dioxide reduces the total greenhouse gas contribution from a heavy oil site. Combusting the variable flow well casing gas with a traditional single burner may be beyond the range of flow capability of a single natural draft burner.

Figure 5:
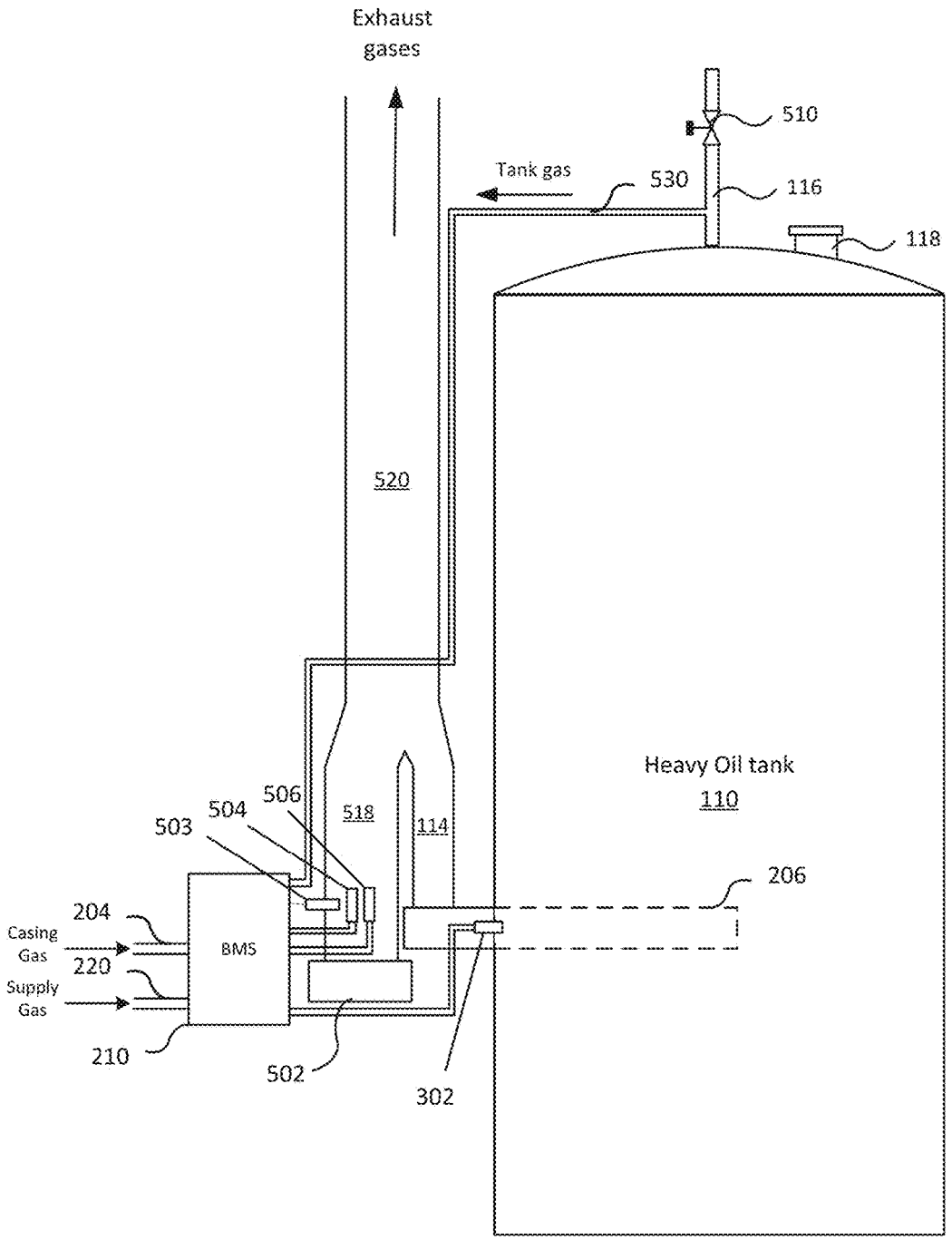
FIG. 5 shows an auxiliary burner system in a heavy oil facility.

In order to provide the capacity to combust the larger amounts of gases from the well casing gas and tank sources, either a secondary exhaust stack with a burner or a larger diameter exhaust stack may be used. Referring to FIG. 5 a larger diameter exhaust stack 518 with a larger diameter flame arrestor 502 than that fitted onto the existing fire-tube heater assembly 112 is added adjacent to the existing burner exhaust stack 114. The individual exhaust ducts are then combined into a single exhaust duct 520, which extends to above the tank for dispersion of the hot exhaust gases. Alternatively, if the amount of excess gas required to combust is typically less than the tank burner capacity, one or more auxiliary burners may be located within the exhaust stack of the tank burner as described in Canadian Patent Application No. 2,822,267. If the amount of excess gas required to combust is greater than the exhaust gas capacity of the exhaust duct, a blower (not shown) can be provided to increase the air flow for the combustion process.

As noted previously, the observed variability in gas flow rate may exceed the normal range of a single natural draft burner head. Two burners 504 506 are provided based upon specific gas flows although more than two burners may be utilized depending on the gas flow requirements.

One or more external shells may be placed around the exhaust duct to reduce the surface temperature for safety reasons and to prevent excess heating of the adjacent tank surface. Provision can be made to allow the heated air between the inner and outer shell to flow upwards to ensure maximum cooling. Optionally the combustion air inlet may be used as well for cooling. The diameters of the individual and combined exhaust ducts may be determined from the burner sizes using well-known engineering practice.

To collect the tank gases 530, the thief hatch 118 and/or the vent 116 at the top of the tank 110 is fitted with a positive pressure relief device 510 or devices, set to open at less than the tank design burst pressure, and a negative pressure relief to prevent an excessive vacuum inside the tank 110. The tank gases 530 can be controlled by a burner management system (BMS) 210. The control of auxiliary burners 504 506 is performed by BMS 210. The BMS 210 may also directly control the burner 302 replacing the existing BMS or may be separate from a gas system controller. The BMS 210 may also control the BMS that controls burner 302.

Figure 6:
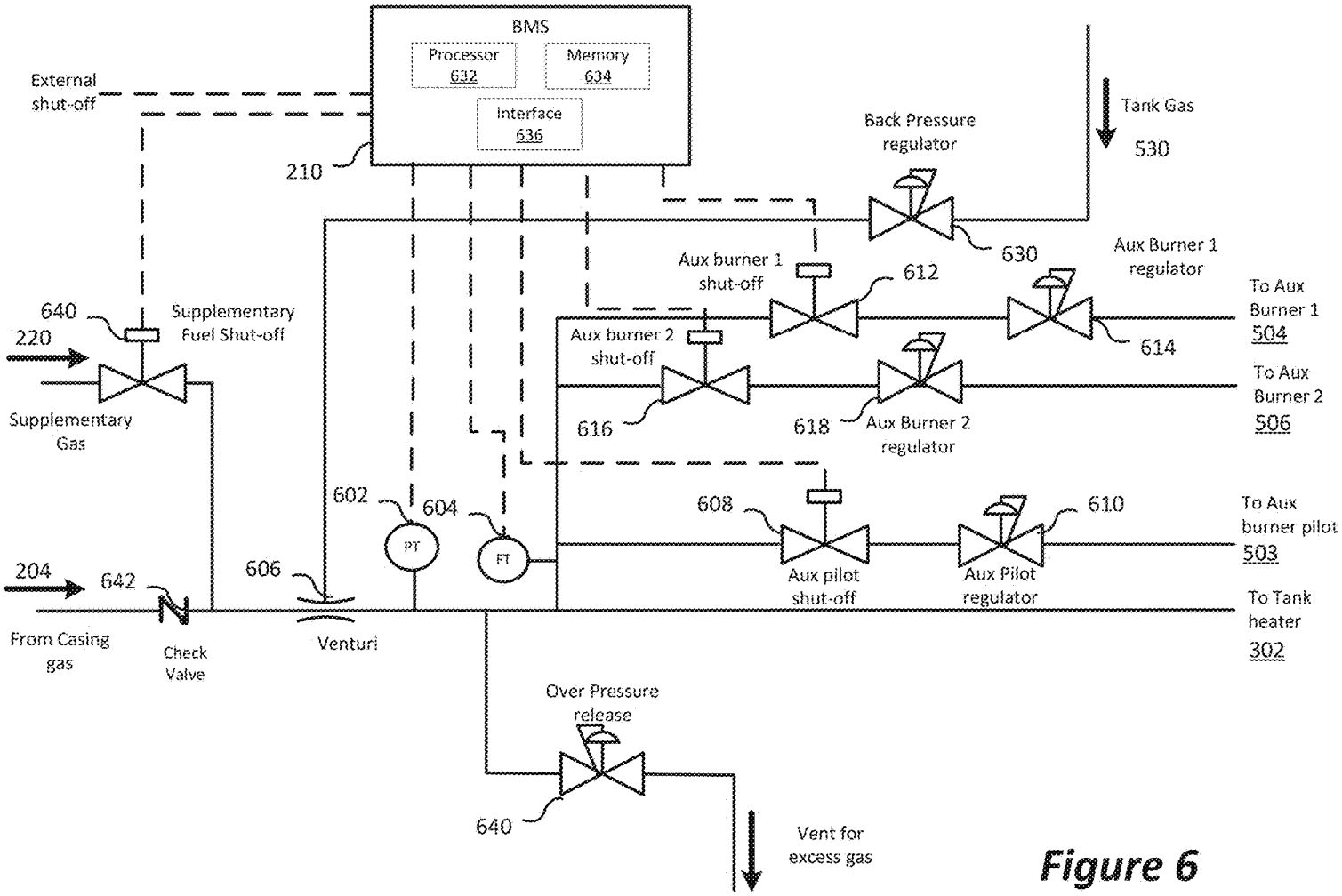
FIG. 6 shows a representation of gas control for the auxiliary burners.

FIG. 6 shows a two burner arrangement where each burner is controlled by a regulator, set at different pressures. The control signals are indicated by dashed lines and the gas flow piping is indicated by solid lines. The tank gas is drawn to the well casing gas flow by the suction provided by a Venturi device or pumping device placed in the fuel gas flow line.

The well casing gas 204 comes at a pressure typically 10 to 100 kPa (1.5 to 15 psig). The primary use of the well casing gas 204 is for heating the liquids in the tank to a set-point temperature. This is normally controlled by the tank heater controller or BMS 210. The BMS 210 is normally an off-on controller so that the tank heater burner may or may not be consuming well casing gas. To manage multiple auxiliary burners 504 506 and optionally burner 302, or the BMS 210 that controls burner 302, a BMS 210 has a processor 632 coupled to a memory 634 a control interface 636. The memory contains instructions for performing burner management. The control interface 636 can receive readings from pressure and/or flow sensors, interface with shut-off valves for initiating gas flow and receive input from one or more sensors such as temperature, pressure or level sensors.

If the well casing gas flow 204 is greater than that required by the tank heater 302 and the local engine, if present, the gas pressure will increase. This pressure is measured by a pressure transmitter (PT) 602, which is connected to the BMS 210. The one or more pressure transmitters may be located in the system for example a PT may be positioned to measure casing gas pressure before the Venture device 606.

When the pressure reaches threshold Ppo, the auxiliary pilot shut-off 608 is opened and the auxiliary pilot 503 is started. If the gas flow to the pilot 503 is insufficient to prevent the well casing gas pressure 204 from continuing to rise, then, when the pilot is proven and threshold value P1*o* is exceeded, the auxiliary burner 1 504 shut-off valve 612 is opened. If the gas consumed by the pilot 503 and auxiliary burner 1 504 is less than the well casing gas flow, then the well casing gas pressure continues to rise. When the threshold value P2*o* is exceeded, the shut-off valve 616 for burner 2 506 is opened. If the well casing gas pressure continues to rise and there is not a third burner, an over pressure release valve 640 allows the excess gas to vent to the atmosphere. When the burner consumption matches the well casing gas flow rate, the well casing gas pressure becomes stable.

The BMS 210 may also cause the tank liquid temperature set-point to increase to enable the tank heater 302 to use well casing gas during high well casing gas flow periods. This strategy can operate in conjunction with the control of the auxiliary burners as described in relation to FIG. 11.

If the well casing gas flow rate increases or decreases, or if the tank burner changes state, the BMS 210 manages the auxiliary burner 504 506 to combust as much of the well casing gas flow as possible. If the well casing gas flow rate decreases, the BMS 210 shuts-off the appropriate auxiliary burners 504 506. Once a specific auxiliary burner is on, the fuel gas pressure must fall below closing threshold values P2*c*, P1*c*, and Ppc respectively to cause the valves to close. The closing pressure thresholds are set below the open pressure thresholds to prevent excessive starting and stopping of the burners.

For each burner 504 506 the pressure regulators 614 618 ensure the fuel gas pressure to the burner does not exceed the maximum for that burner may be provided. Similarly a pilot regulator 610 may be provided for the auxiliary burner pilot 503. There may be addition burners that come on at increasing pressure threshold values.

If the well casing gas 204 pressure becomes too low as a result of low or no flow, the BMS 210 opens a valve 640 to supply supplementary fuel 220 to the tank burner and its pilot. A check valve 642 prevents the supplementary fuel 220 flowing to the well.

The fuel gas, from the supplementary gas 220 and well casing gas 204 provided to the burners can pass through a Venturi device 606 sized such that tank gas 530 can be drawn in from the tank 110. A back-pressure valve 630 in the pipe leading to the tank vent 116 can be set such that the suction pressure does not drop below atmospheric pressure.

An optional flow sensor and transmitter (FT) 604, may be inserted as shown to measure the well casing gas 204 consumed by the auxiliary pilot 503 and the auxiliary burners 504 506. For reliability purposes the pilot may use supplementary gas supply. From this flow, and the methane concentration in the well casing gas, the reduction in $CO_2e$ (Carbon Dioxide Equivalent) emissions by combusting the methane may be calculated. The tank gas 530 may also be routed to the pilot.

Figure 7:
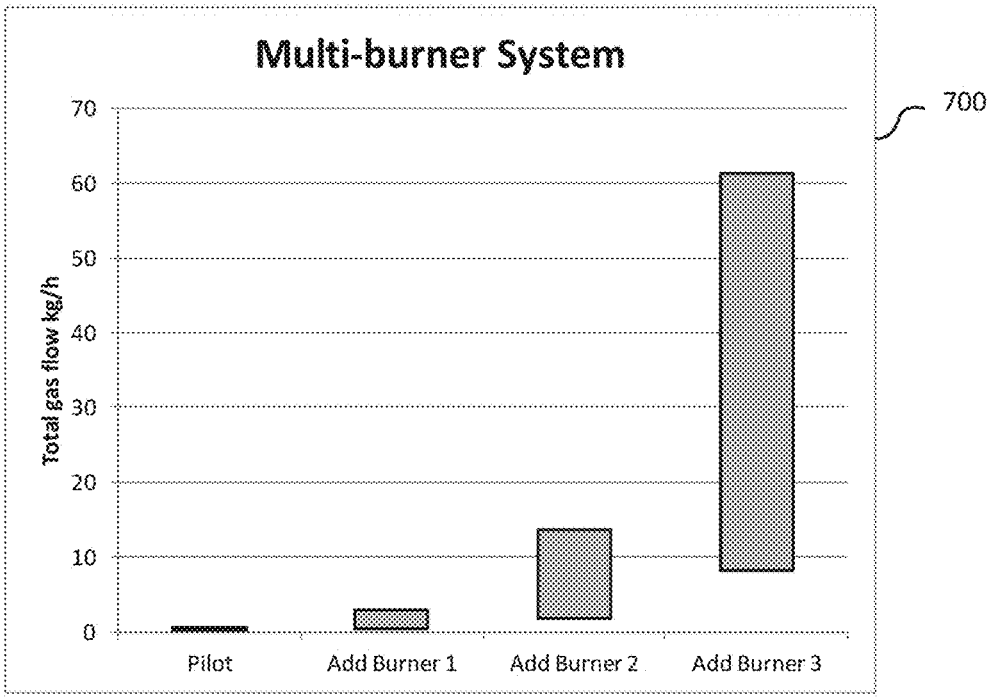
FIG. 7 shows a graph of multi-burner flow ranges.

The flow ranges for a sequential system are shown schematically in graph 700 of FIG. 7. The gas flow available the burners may be sequentially initiated as to meet the desired capacity such that multiple burners may be active simultaneously to meet demand. Alternatively the burner which meets the flow capacity may be selected by the BMS 210, for example burner 2 may be selected if the flow rate is below 12 kg/h but higher than 5 kg/h and burner 3 may be selected when the flow rate is above 10 kg/h.

In cold weather, condensation and freezing of the water in the tank vent gases at the tank vent 116 (see FIG. 1) can cause operational problems. There are several methods of dealing with icing problems caused by the freezing of the water vapour component of the escaping tank gases. One method is the use of a tank hatch with a positive and negative pressure release. Sometimes a blanket gas system is used to exclude air from the tank, when materials are pumped out of the tank. The high water vapour content in the tank gas can cause blockages due to freezing if the ambient temperature falls below 0° C. (32° F.). Careful routing of the pipe conducting the tank gas from the top of the tank to the Venturi to take advantage of the heat from the stack is important in cold weather climates. An alternative is to add parallel tubing for conducting the warm engine coolant 126 along this pipe in the same manner as that shown in FIG. 1 by item 108.

Figure 8:
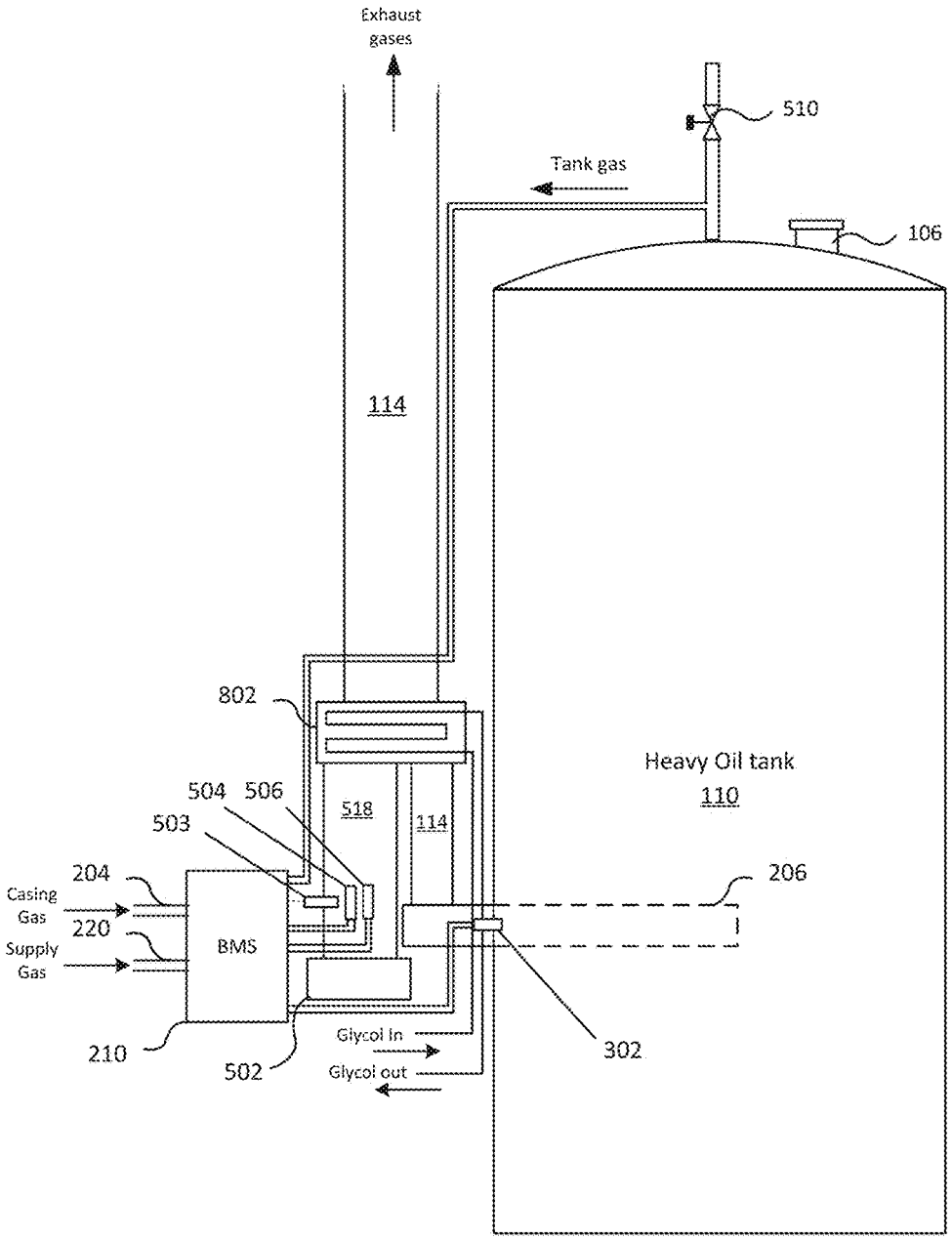
FIG. 8 shows an auxiliary burner system with a heat exchanger.

FIG. 8 shows how the hot exhaust gases can be used for heating of the tank gas line. In cold climates there may be the need for additional heat to prevent freezing of the gas and well liquid lines from the well to the tank. This may be provided with the insertion of a heat exchanger 802 as shown in FIG. 8. A pump is required to circulate the glycol coolant and a thermostat may be required for temperature control. The stack 114 is fitted with the heat exchanger 802 to provide additional heat to the glycol from the engine that is used to heat the pipes carrying the gas and liquids to the tank 110.

In the multiple burner arrangement there are a number of burner control strategies that can be contemplated according to the control software in the system controller. The simplest is a sequential method as described in connection with FIG. 9; although more complex arrangements are possible. For example the number of burners may be initiated based upon a pressure reading and/or flow readings where varying sized burners may be selected to optimally consume excess well casing or tank gas at a desired rate such as for example described in connection with FIG. 10.

Figure 9:
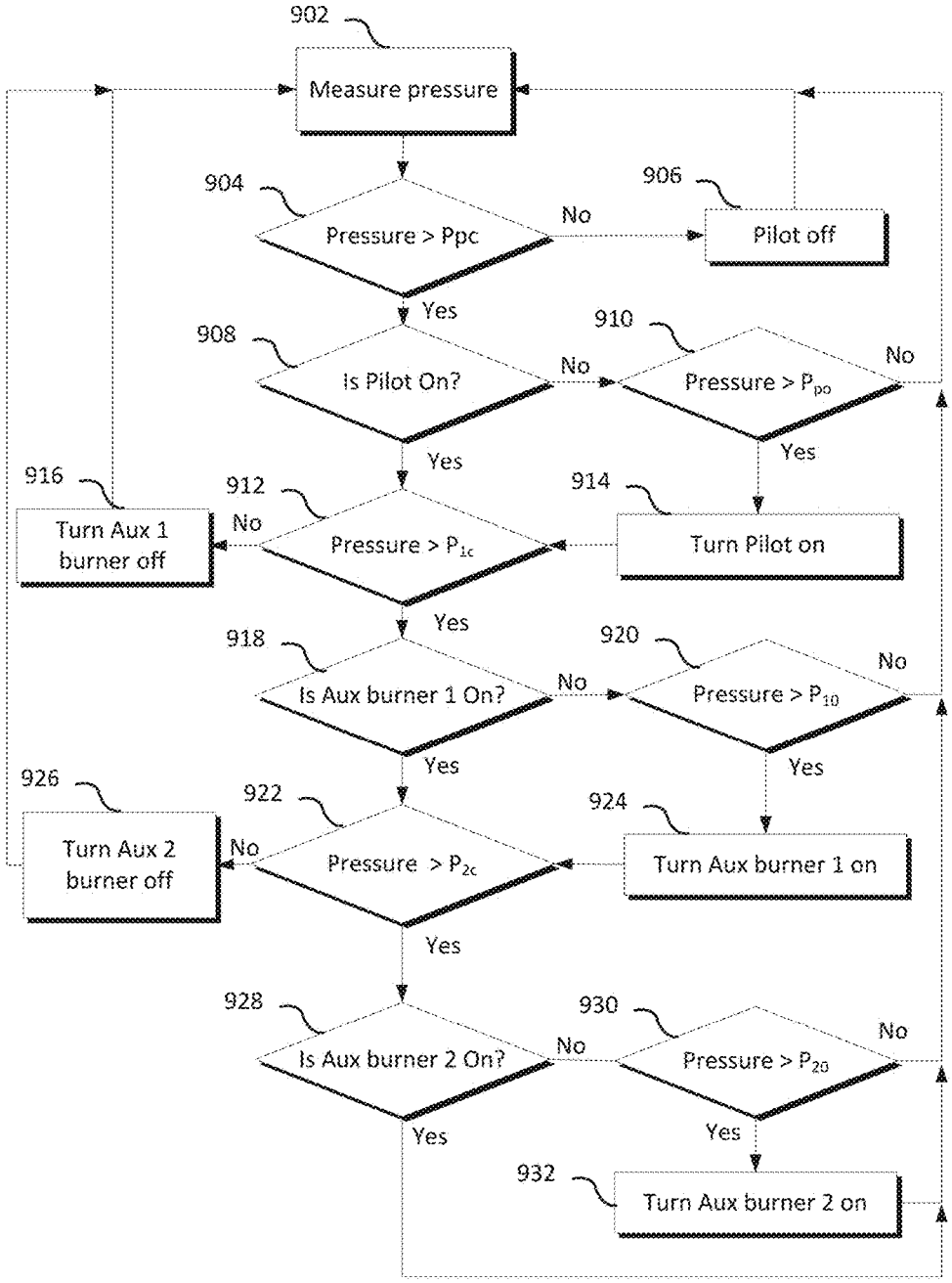
FIG. 9 shows a method of auxiliary burner management with sequential burner activation.

FIG. 9 shows a method of auxiliary burner management with sequential burner activation. The method provides for sequential operation of burners where the burners of are of the same flow size or increasing flow size. The controller utilizes a measurement from the pressure sensor to determine a pressure of well casing gas and/or tank gas pressure (902). If the pressure is greater than a shut-off threshold Ppc for the pilot (YES at 904), it is then determined if the pilot is on (908). If the pressure is less than Ppc (NO at 904) then pilot is off (906).

If the pilot is not on (NO at 908) it is determined if the pressure is greater than the open pressure Ppo of auxiliary burner 1 (910). If the pressure is greater than Ppo (YES at 910), the pilot is turned on (914). If the pressure is less than Ppo (NO at 910), the gas pressure is measured (902) until a change occurs.

If the pilot is on (YES at 908) and the pressure is greater than the closing pressure P1*c* for auxiliary burner 1 (YES at 912), it is determined if the auxiliary burner 1 is on (918). If the pressure is not greater than P1*c* (NO at 912), the burner is off (916).

If the auxiliary burner 1 is not on (NO at 918), it is determined if the pressure to open auxiliary burner 1 P1*o* is exceed (YES at 920) and the auxiliary burner 1 is turned on (924). If the pressure is not greater than P1*o* (NO at 920) the pressure is monitored for changes.

If the auxiliary burner 1 is on (YES at 918), the pressure is compared to the close pressure P2*c* of auxiliary burner 2 (922). If the pressure is not greater than P2*c* (NO at 922), auxiliary burner 2 is off (926). If the pressure is greater than P2*c* (YES at 922), it is determined if the auxiliary burner 2 is on (928). If the auxiliary burner 2 is on (YES at 928) the pressure is measured until a change occurs, otherwise if auxiliary burner 2 is not on (NO at 928) and the pressure is greater than the open threshold P2*o* for auxiliary burner 2 (YES at 930), the burner is turned on (932). If the pressure does not exceed P2*o*, the burner is not turned on and the pressure is measured for changes (902). The respective pressure threshold values for initiating the auxiliary burners are determined based upon the flow rate characteristics of the respective auxiliary burner. The burners may be of varying sizes, the same size, or a combination dependent on the expected flow rates, heating capacity, stack heating parameters or emission requirements. The pressure threshold values are determined to provide hysteresis between turning on and turning off and reduce possibility of the burner having to start up soon after it is shut-off.

Figure 10:
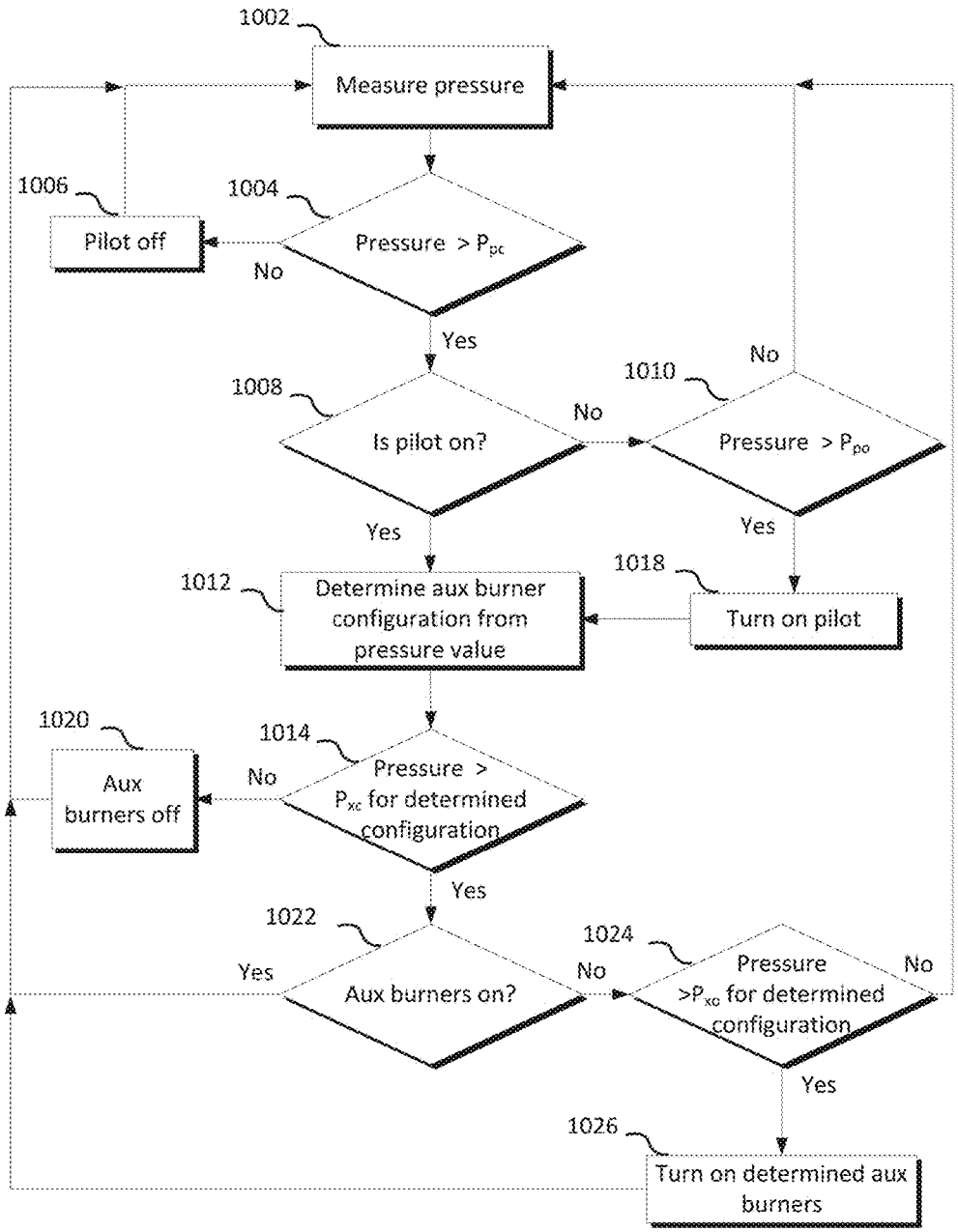
FIG. 10 shows a method of auxiliary burner management with dynamic burner activation.

FIG. 10 shows a method of auxiliary burner management with dynamic burner activation. As opposed to sequential operation, individual burners may be selected dynamically to meet pressure or flow requirements of excess gas. The controller utilizes a measurement from the pressure sensor to determine a pressure well casing gas and/or tank gas pressure (1002). If the pressure reaches a close threshold value Ppc for the pilot (Yes at 1004), and the pilot is not on (NO at 1008), and the open threshold Ppo for the pilot is exceed (YES at 1010), the pilot is started (1018). If the pressure is below Ppc (No at 1004), the pilot is off (1006).

If the pressure value does not exceed Ppo (NO at 1010), the pilot remains off (1002) and the auxiliary burner system is not initiated. If the pressure is above Ppo (YES at 1010), the pilot is ignited (1018). The pressure value can be utilized to determine if a burner configuration for the pressure value (1012). For example, the pressure value may be mapped to a capacity range of a specific burner or to a capacity range provided by a combination of burners.

If the pressure is not greater than a close threshold Pxc for the determined burning configuration (NO at 1014), the auxiliary burners are off (1020). If the pressure exceeds Pxc (YES at 1014), it is determined if the auxiliary burners are on (1022). If the respective burners are on (YES at 1022), the process continues until a pressure change occurs (1002). If the determined burners are not on (NO at 1022), the pressure value is compared to the open threshold value Pxo (1024) for the determined burner configuration. If the open pressure threshold is exceeded (YES at 1024), the determined burners are initiated (1026). If the Pxo is not exceeded (NO at 1024), the pressure is measured until a change occurs (1002). The burner configuration required for the pressure may be based upon the number of burners and the size of each of the burners based upon their maximum flow rate capability. The number of burners can be selected based upon a consumption rate determined by a combination of the burners either individually or sequentially. The threshold Pxc and Pxo can be dynamically determined based upon parameters of the provided burners and defined capacity range for a combination of burners relative to the determined pressure. The respective pressure threshold values are determined based upon the flow rate characteristics of the burners provided in the system. The burners may be of varying sizes, the same size, or a combination dependent on the expected flow rates, heating requirement, stack heating parameters or emission standards.

Figure 11:
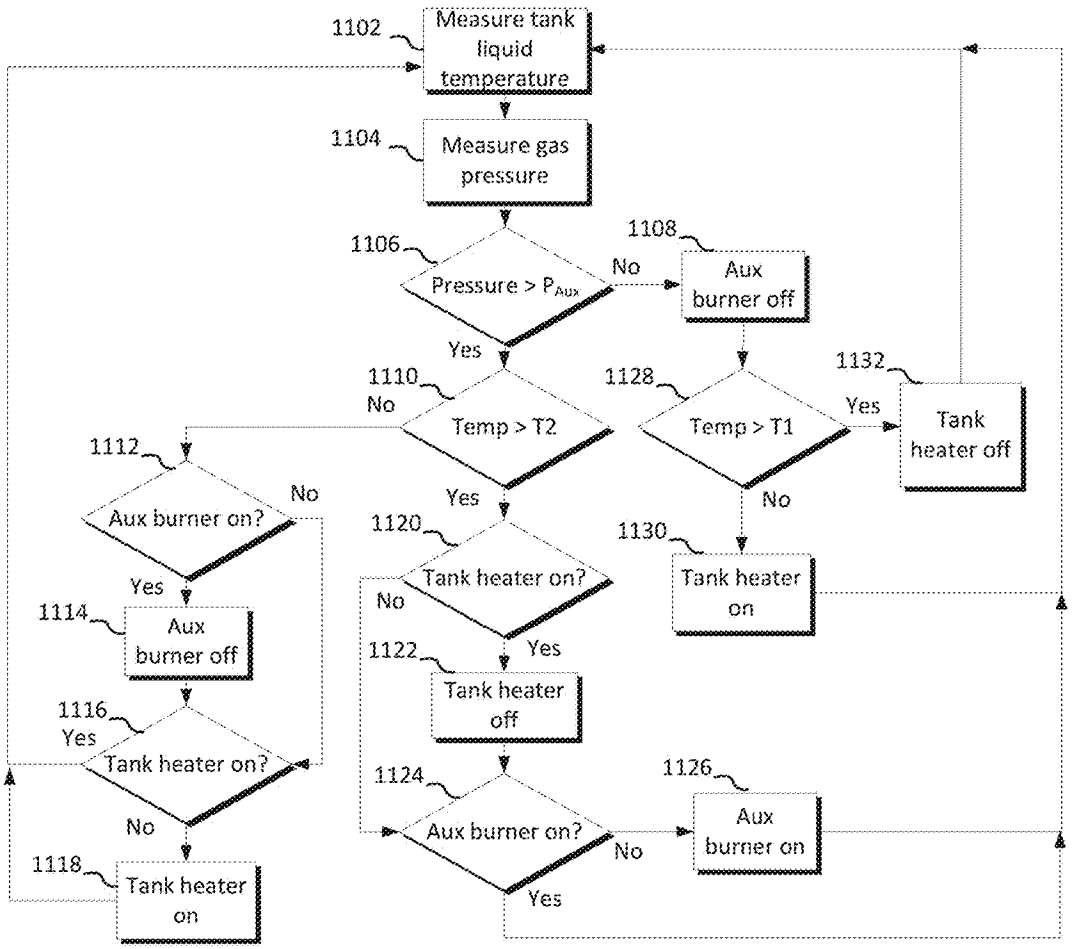
FIG. 11 shows a method of tank heating management set-points with auxiliary burner management.

FIG. 11 shows a method of tank heating management set-points with auxiliary burner management. In the standard arrangement, the fire-tube heater for the tank liquids is turned on and off to maintain a liquids temperature near to a pre-set fixed temperature set-point. For some wells the casing gas flow amount may change less frequently relative to the example shown in FIG. 4 and may drop to zero flow for an extended period up to a few hours.

In order to maximize the use of the well casing gas, when it flows, a strategy where a second higher temperature set point is used can enable greater use of the well casing gas for heating the tank liquids. The method can be used in conjunction with the method of FIGS. 9 and 10 for initiating the auxiliary burners. For a time estimation consider a 1000 barrel (US) tank ½ full with a mixture of 90% water and 10% heavy oil heated an extra 10 degrees C. With a typical 500,000 BTU/h burner in the fire-tube, it would take about 6 hours to heat the liquid an additional 10 degrees C., without considering heat losses by the tank to the ambient. This strategy could substantially reduce the need for supplementary gas to keep the tank liquids warm.

The tank liquid temperature is measured (1102) and the well casing gas pressure is measured (1104). If the well casing gas pressure is at or below the pressure threshold value (NO at 1106) required to cause the controller to initiate an auxiliary burner (1108), and the liquids temperature is below the minimum desired liquid temperature T1 (NO at 1128), then the tank heater is turned on (1130) until the desired temperature T1 is reached or the pressure changes. If the well casing gas pressure is above that necessary for an auxiliary burner (YES at 1106), and the liquids temperature is equal to or below a maximum temperature T2 (NO at 1110), if the auxiliary burner is on (YES at 1112), the burner is turned off (1114).

If the tank heater isn't on (NO at 1116), it is then started (1118) and allowed to continue until either the well casing gas pressure drops below that necessary for the auxiliary burner operation or the liquids temperature exceeds a maximum temperature T2 (YES 1110). If the temperature is greater than T2 and the tank heater is on (YES at 1120), it is turned off (1122). If the tank heater is not on (NO at 1120) and the auxiliary burner is not on (NO at 1124), the auxiliary burner selection process can be initiated (1126) until the pressure is reduced. Since the heat capacity of the tank liquids is substantial compared to the fire-tube heater output, by utilizing two temperature set points more of the well casing gas may be used and less make-up supplementary gas will be required. Alternatively, it may be desirable to have the auxiliary pilot on at all times or when-ever the tank heater burner 302 is not on. The benefit of having the pilot on at all times is that if the casing gas 204 comes in short bursts, there will be no delay due to the ignition and proving of the pilot flame. For a continuous pilot, often known as a standby pilot, the fuel may be supplied from the supplementary gas source 220.

Figure 12A:
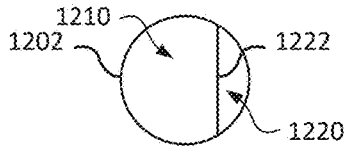
FIG. 12*a* shows top view of a single stack arrangement.
Figure 12B:
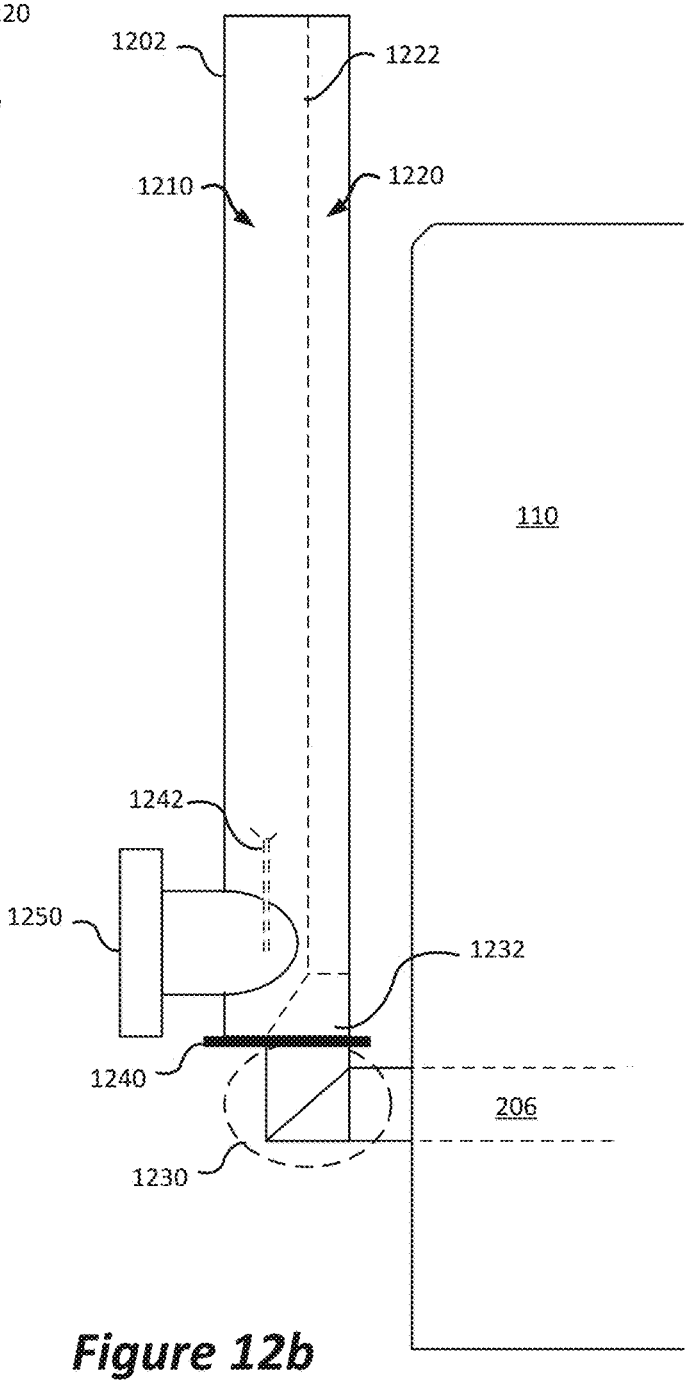
FIG. 12*b* an auxiliary burner system using a single stack arrangement.

FIG. 12*a* shows top view of a single stack arrangement and FIG. 12*b* shows an auxiliary burner system using a single stack arrangement. In the embodiment described a single stack 1202 configuration that can be utilized to address technical problems in the combustion of the excess gas in heavy oil production is that there may be a need for both the main tank heater to operate at the same time as the Aux burner. In the FIG. 5 arrangement there is a risk the main burner exhaust gases may flow out through the auxiliary burner flame arrestor is the auxiliary burner is not on. While a second stack could easily be erected adjacent to the original stack to ensure the two burners came operate independently, there are disadvantages to this in terms of possible licensing and customer acceptance issues.

A single stack 1202 for the two burners avoids this problem, but allows the single stack to become very hot when the auxiliary burner is on. The exhaust gases from the main burner has given-up most of their heat in the main burner fire-tube an do not generate a large heat flux toward the tank. The heat radiated to the adjacent tank surface when the auxiliary burner is on could melt the tank insulation or cause the insulation to ignite. To address this issue the stack 1202 geometry can be utilized to incorporate both main burner stack 1220 and auxiliary burner stacks 1210 which significantly reduces the heat flux directed at the tank when the auxiliary burner is on. The stack 1202 is divided or partitioned by internal wall 1222. In addition it allows the main and auxiliary burners to operate independently. The stack heating associated can also be reduced by the addition of a duct fan inside the auxiliary burner flame arrestor. The divider 1222 may only extend a portion of the length of the stack 1202.

The single stack 1202 replaces an existing 8" or 10" stack with a 16" diameter stack for example having an internal divider 1222 in the 16" stack to divide the stack into two sections. Suitable placement of the divider will ensure the section of the stack facing the insulated tank will not have an excessive temperature based upon the capacity requirements of the burners. Although specific stack diameters are described the stack diameters may vary based upon heat dissipation requirements.

A BMS 210 can route the well gas either to the main tank burner, which is controlled by the tank liquid temperature, or to one or more of the auxiliary burners 1242. A side section connected to a suitably sized flame arrestor 1250 provides the necessary air for the auxiliary burners 1242 The BMS 210 will determine which burners are required according to the casing gas pressure set point.

The single stack 1202 can have an internal transition 1232 piece within the stack. An adapter 1230 can connect the main burner fire tube 206 to flange 1240. The angle subtended by the internal stack divider may be calculated as shown below. For a stack area equivalent to that of an 8" diameter stack the angle should be about 87 degrees. To increase the area to be equivalent to a 10" stack, the subtended angle should be 105 degrees.

Figure 13:
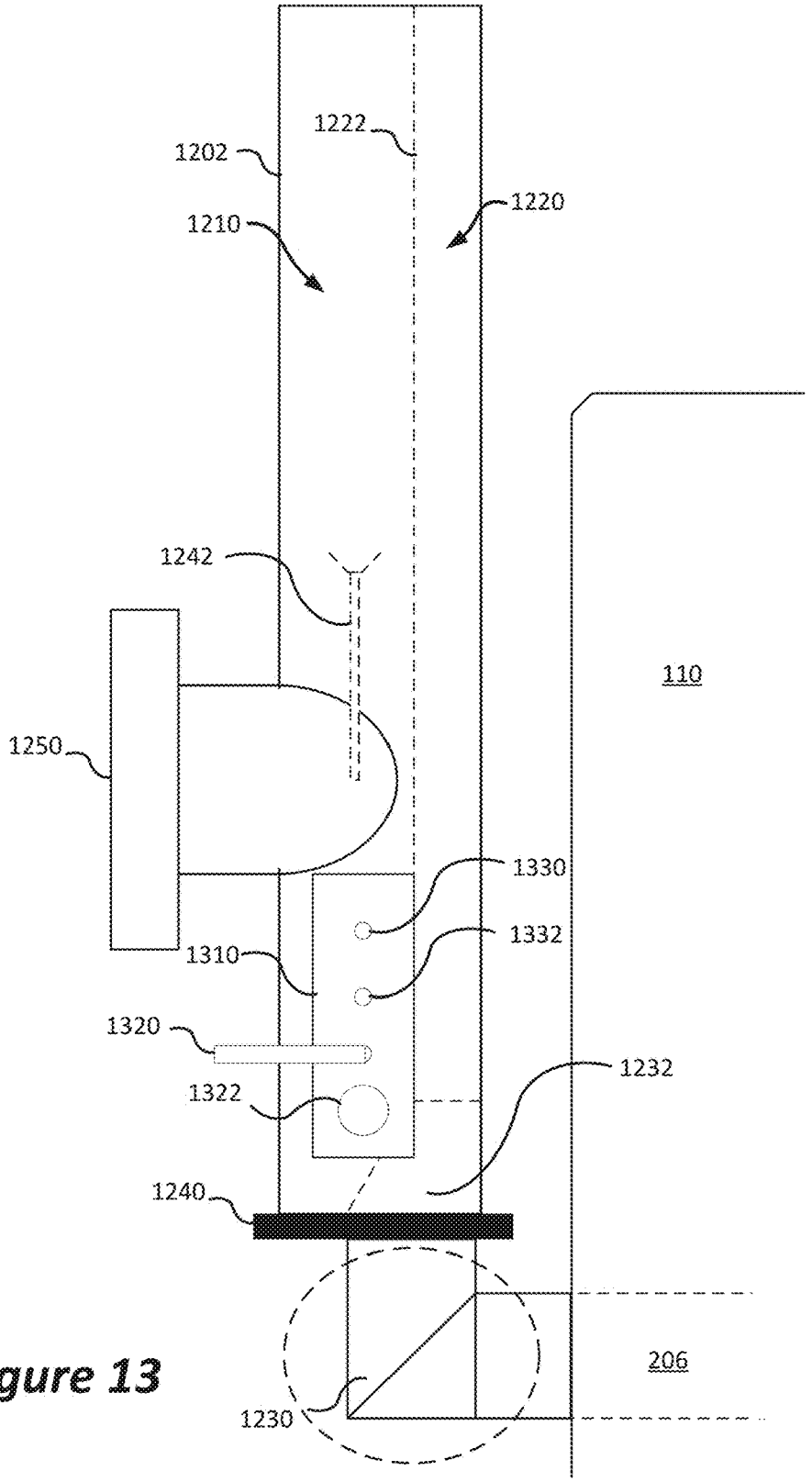
FIG. 13 shows an auxiliary burner system using a single stack arrangement and a heat exchanger.

FIG. 13 shows an auxiliary burner system using a single stack arrangement and a heat exchanger. There is a requirement for many sites to provide additional heat to the glycol-water coolant heating the oil and gas flow lines between the well and the liquids tank. While it is natural to extract the necessary heat from the auxiliary burner section, there are significant engineering challenges with this approach. The simpler approach is to design an on-demand gas heater 1310 specifically for the purpose of providing the additional heat according to a coolant temperature sensor. Such a heater could exhaust to the stack 1202 or be installed in the volume at the bottom of the stack.

The master controller would determine the source of the gas needed for the coolant heater 1310. The heat provided to the engine coolant at 50% engine load is 900 to 1000

BTU/m≈60,000 BTU/h. If the gas heater adds 50% to the heat available, then the heater requirement is 30,000 BTU/h. If the heater system runs at 70% efficiency, then, at 910 BTU/scf, the burner gas flow required would be 47 scf/h=1.3 $m^3$/h=0.9 kg/h. The heater 1310 will have a cold coolant inlet 1332 and a warm coolant outlet 1330. A flame arrestor 1322 can extend outside of the stack 1202.

This amount of gas 1320 provided to the heater 1310 is relatively small compared to the total capacity of the Aux burner (21 $m^3$/h). Hence the gas heater could be fitted inside the aux burner enclosure with fittings for connecting to the existing coolant flow loop, powered by the engine supplementary coolant pump. The coolant heater 1310 can be a bolt-in insert below the auxiliary burner. The exhaust gases could be vented into the portion of the stack used for the main fire-tube heater 1220.

Although the description discloses example methods, systems and apparatus including, it should be noted that such methods, systems and apparatus are merely illustrative and should not be considered as limiting. Accordingly, while the preceding describes example methods, systems and apparatus, persons having ordinary skill in the art will readily appreciate that the examples provided are not the only way to implement such methods, systems and apparatus. Portions of the burner management system can be implemented using one or more computer processors for processing and receiving sensor data to actuating burner management functions. A non-transitory computer readable medium can be provided for storing instructions which when executed by a processor perform the method described.

The scope of the claims should not be limited by the preferred embodiments set forth in the examples, but should be given the broadest interpretation consistent with the description as a whole.

What is claimed is:

1. A system for vent gas combustion in storage tank for heavy oil production, the system comprising:

a pressure sensor for determining a gas pressure value of well casing gas;

a first auxiliary burner located for combusting the well casing gas;

a second auxiliary burner located with the first auxiliary burner for combusting the well casing gas; and a burner management system for controlling the first and second auxiliary burners, the burner management system receiving the gas pressure value and initiating the first auxiliary burner and second auxiliary burner based upon one or more threshold values when the gas pressure exceeds the one or more pressure values;

wherein an auxiliary exhaust stack is coupled to a tank heater exhaust stack from a tank heater in the storage tank for heating oil stored in the storage tank wherein the tank heater exhaust stack and auxiliary exhaust stack join a main exhaust stack having a larger diameter than the auxiliary exhaust or tank heater exhaust.

2. The system of claim 1 wherein the first and second auxiliary burners are collocated within the auxiliary exhaust stack.

3. The system of claim 2 wherein the first and second auxiliary burners are collocated within the auxiliary exhaust stack next to the tank heater exhaust stack.

4. The system of claim 3 further comprising a blower to supply additional air to the first auxiliary burner and second auxiliary burner.

5. The system of claim 1 wherein a heat exchanger is coupled to the main exhaust stack.

6. The system of claim 2 wherein the tank heater exhaust stack from the tank heater shares a common exhaust stack with the auxiliary exhaust stack.

7. The system of claim 2 wherein a common exhaust stack is divided to provide the auxiliary exhaust stack and the tank heater exhaust stack from the tank heater.

8. The system of claim 1 further comprising a pilot for the first auxiliary burner and second auxiliary burner, wherein the pilot is initiated prior to initiating of the first auxiliary burner or second auxiliary burner when the gas pressure exceeds a pilot pressure threshold value.

9. The system of claim 1 further comprising a pilot for the first auxiliary burner and second auxiliary burner, wherein the pilot is on at all times.

10. The system of claim 1 further comprising a pilot for the first auxiliary burner and second auxiliary burner, wherein the pilot is on when the tank heater is not on.

11. The system of claim 1 further comprising a pressure sensor for determining pressure of gas from the storage tank wherein excess gas from the storage tank is provided to the first or second auxiliary burners.

12. The system of claim 1 further comprising a Venturi device for passing well casing gas to the first and second auxiliary burners and for drawing gas from the storage tank.

13. The system of claim 12 further comprising a back-pressure valve coupled to a tank vent of the storage tank such that suction pressure does not drop below one atmosphere.

14. The system of claim 1 wherein an over pressure release is opened to vent excess gas when pressure exceeds a capacity of the first and second auxiliary burners.

15. The system of claim 1 comprising a regulator associated with each of the respective first and second auxiliary burners.

16. The system of claim 1 wherein the first and second burners are initiated sequentially as the pressure value increases.

17. The system of claim 1 wherein the first auxiliary burner and second auxiliary burner are each associated with a respective shut-off valve, the respective shut-off valve is opened or closed by the burner management system.

18. The system of claim 1 wherein the second auxiliary burner is a larger capacity than the first auxiliary burner.

19. A method for vent gas combustion from a storage tank for heavy oil production performed by a burner management system controller, the method comprising:

determining a gas pressure value of well casing gas;

initiating a first auxiliary burner to combust the well casing gas when a first on-pressure threshold value is exceeded, the first auxiliary burner is active until the pressure value is below a first off-pressure threshold; and initiating a second auxiliary burner located the second auxiliary burner to combust well casing gas when a second on-pressure threshold value is exceeded, the second auxiliary burner is active until the pressure value is below a second off-pressure threshold;

wherein the first auxiliary burner and second auxiliary burner are initiated dynamically based upon the pressure value and a respective capacity of the first auxiliary burner and second auxiliary burner.

20. The method of claim 19 wherein a tank heater is initiated when the gas pressure value is below one or more threshold values and a liquid in the storage tank coupled to the tank heater is below a first desired temperature.

21. The method of claim 20 wherein the tank heater is initiated when the gas pressure value is above the one or more threshold values and the liquid in the storage tank is below a second desired temperature.

* * * * *